United States Patent [19]

Burton

[11] 4,218,098

[45] Aug. 19, 1980

[54] SKATE WHEEL ASSEMBLY

[76] Inventor: Elwin E. Burton, 6530 SE. 89th Ave., Portland, Oreg. 97266

[21] Appl. No.: 942,650

[22] Filed: Sep. 15, 1978

Related U.S. Application Data

[63] Continuation-in-part of Ser. No. 921,367, Jul. 3, 1978, abandoned.

[51] Int. Cl.[2] ..... A63C 17/22

[52] U.S. Cl. ..... 301/5.7; 301/63 PW; 308/210; 152/323

[58] Field of Search ..... 308/191, 192, 210, 211; 16/45, 46; 301/5.3, 5.7, 63 PW, 63 D, 63 DS; 152/323, 324, 326, 302, 303

[56] References Cited

U.S. PATENT DOCUMENTS

| | | | |
|---|---|---|---|
| 828,033 | 8/1906 | Lachman | 16/45 |
| 859,374 | 7/1907 | Dickinson | 308/191 |
| 2,105,354 | 1/1938 | Hoerle | 301/5.7 |
| 2,252,132 | 8/1941 | Mazveskas et al. | 301/5.7 |
| 2,552,035 | 5/1951 | Cooke et al. | 301/5.7 |
| 2,572,835 | 10/1951 | Bloom | 301/5.7 |
| 3,895,844 | 7/1975 | Mertler | 301/63 PW |
| 3,905,649 | 9/1975 | Kosono et al. | 301/5.7 |
| 4,114,952 | 9/1978 | Kimmell | 301/5.7 |

FOREIGN PATENT DOCUMENTS

| | | | |
|---|---|---|---|
| 6614 | of 1910 | United Kingdom | 301/5.7 |
| 780760 | 8/1957 | United Kingdom | 301/5.7 |

*Primary Examiner*—H. Grant Skaggs
*Attorney, Agent, or Firm*—Eugene M. Eckelman

[57] ABSTRACT

A hub or body portion of a skate wheel assembly is supported on an axle through the medium of spaced bearings which provide good support for the hub. The hub is flanged and also has a tongue and groove connection with the tire to hold the tire on and in addition to uniformly distribute stresses therebetween. The tire is removably supported on the hub portion for easy replacement or for substitution of another type of tire, and the parts in one embodiment are constructed and arranged also such that the tire can be reversed end for end. Some embodiments of the invention have an internal construction providing three bearing support of the hub on a wheel spindle.

3 Claims, 10 Drawing Figures

SKATE WHEEL ASSEMBLY

REFERENCE TO PRIOR APPLICATIONS

This application is a continuation in part of application Ser. No. 921,367, filed July 3, 1978, now abandoned.

FIELD OF THE INVENTION

This invention relates to new and useful improvements in skate wheel assemblies.

SUMMARY OF THE INVENTION

According to the present invention and forming a primary objective thereof a skate wheel assembly is provided which includes a novel support for a tire and which in one embodiment has a novel bearing arrangement designed to provide minimum friction, minimum stress, and maximum support between a hub and a wheel spindle.

Another object is to provide a skate wheel assembly providing for ready replacement or substitution of a tire portion.

In carrying out the above objectives, the invention employs a wheel hub or body portion supported on an axle spindle by bearings spaced along the spindle for improved support. The hub supports a removable tire and such hub and tire have tongue and groove engaging means to provide a stable non-rotating connection as well as to uniformly distribute stresses therebetween and furthermore to hold the tire on the body portion. The tire is also held in place by flanges on the ends of the hub, all embodiments of the invention providing for ready replacement of the tire.

The invention will be better understood and additional objects and advantages will become apparent from the following description taken in connection with the accompanying drawings.

DETAILED DESCRIPTION OF PREFERRED EMBODIMENTS

Figure 1:
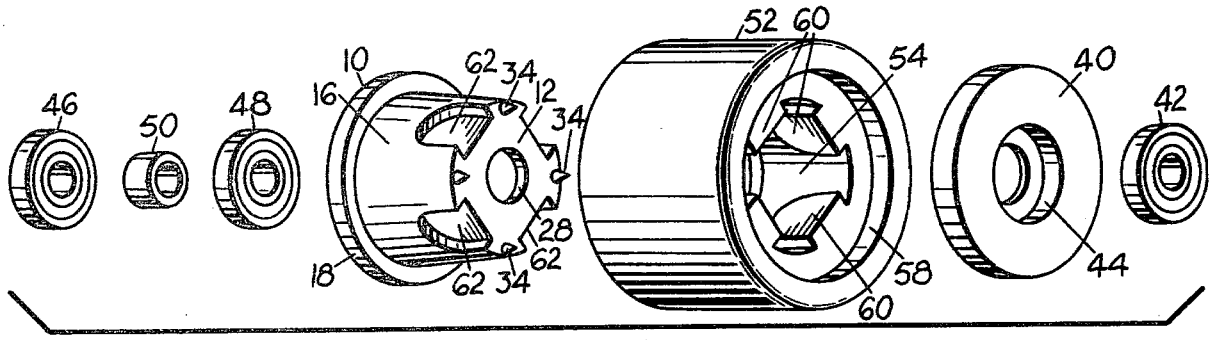
FIG. 1 is an exploded view of a skate wheel assembly embodying a first form of the instant invention.
Figure 3:
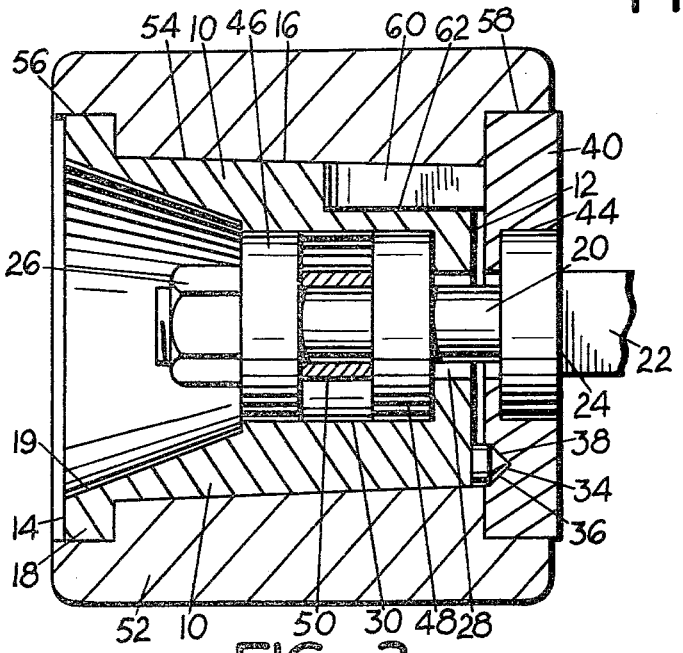
FIG. 3 is a sectional view taken on the line 3—3 of FIG. 2.
Figure 2:
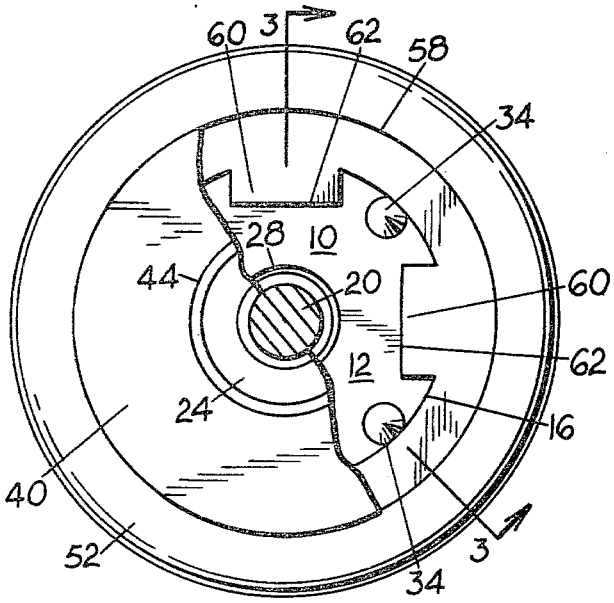
FIG. 2 is an end view of the assembly of FIG. 1, this view being partly broken away and taken from the right side of FIG. 3.

The embodiments of the present wheel assembly were designed for use with skateboards but such wheel assemblies can as well be used for any other purpose such as roller skates or other wheeled mechanisms. With reference first to the embodiment of FIGS. 1–3, a hub or body portion 10 has inner and outer ends 12 and 14, respectively. This hub portion has a cylindrical outer surface 16 tapered to a slightly smaller diameter toward its inner end and having a peripheral flange 18 at its outer end. A deep, tapered recess 19 is provided in the outer end 14 to conserve on material as well as to provide some flexibility for the hub particularly if such hub is molded or otherwise formed of a resinous plastic or the like.

Hub portion 10 is supported on the spindle 20 of an axle 22, a shoulder 24 being provided at the inner end of the spindle. The outer end of the spindle terminates in a threaded portion to receive a nut 26. Hub 10 has a bore 28 for freely receiving the spindle and also has a counterbore 30 which opens into recess 19.

The inner end 12 of hub portion 10 has projections 34 with pointed ends 36 which engage in correspondingly shaped recesses 38 in a face surface of a second hub portion 40 in the form of a retaining disc. Bearing support for the hub portion 40 on the spindle 20 is accomplished by an inner bearing 42 engaged with the spindle 20 and fitted snugly in a recess 44 in the hub portion 40. A support and non-rotating connection between the inner end of the hub portion 10 and the hub portion 40 is accomplished by the projections 34. The inner ends of the bearing 42 and hub portion 40 are flush with each other and bearing 42 has abutment against shoulder 24.

The bearing support of the hub portion 10 on the spindle includes a second bearing 46 fitted in the counterbore 30 adjacent the outer end of the spindle and a third bearing 48 spaced inwardly from bearing 46 and also fitted in the counterbore 30 at the inner end of the latter. A spacer 50 is freely contained on the axle portion 22 between bearings 46 and 48. In a preferred arrangement, the three bearings are approximately equally spaced along the spindle.

In the mounted assembly of the hub portions, the nut 26 bears against bearing 46 which in turn firmly locks the bearing 48 in place by means of spacer 50. This inward force bears firmly against hub portion 40 and bearing 42 which in turn bear against shoulder 24, with the result that the hub portions 10 and 40 have a firmly held triple support engagement on the spindle. This arrangement provides a good support for a wheel and particularly for a wide one as shown and also for a wheel having a deepened end recess wherein support must be provided at substantially the inner half of the wheel.

The hub portions 10 and 40 support a tire 52 constructed of rubber, plastic, or other suitable material. The tire 52 comprises a tubular open-ended member with an inner surface 54 of suitable diameter and taper to fit snugly on the outer tapered surface 16 of the hub portion 10. The inner surface 54 of the tire has an end notch 56 at its outer end which allows a portion of the tire to fit over the flange 18. The other end of the tire has a notch 58 which allows a portion of the tire to fit over the hub portion 40, the tire being confined between the opposing edges of flange 18 and hub portion 40.

It is preferred that the tire 52 and the hub portion 10 be locked together against relative rotation, and for this purpose these parts have an interfitting tongue and groove connection. As shown, the tire has a plurality of longitudinally extending tongues or projections 60 engageable with grooves 62 in the surface 16 of the hub portion 10, the outer ends of these tongues and grooves being rounded. In addition to providing a non-rotatable fit between the members 10 and 52, the tongue and grooves 60 and 62 provide an abutment in a longitudinal direction whereby forces which may tend to displace the tire 52 in an outward direction, such as those forces which may arise during sharp maneuvers of a skateboard, are taken up both by the flange 18 and by the inner ends of tongues 60 bearing against the ends of the grooves 62. The tapered engagement of the hub portion 10 and the tire 52 also tends to keep the tire on the wheel even during sharp maneuvers and even when a fairly resilient tire is used.

Figure 4:
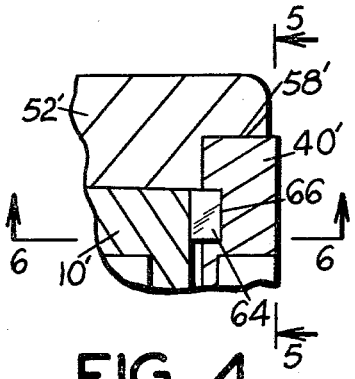
FIG. 4 is a fragmentary sectional view taken similarly to FIG. 3 but showing a modified structural arrangement of the connection between portions of the hub.
Figure 5:
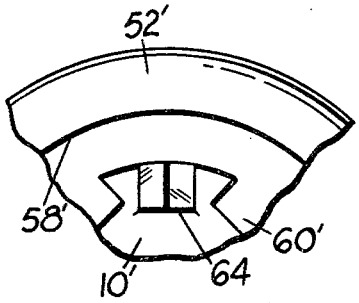
FIG. 5 is a fragmentary elevational view taken on the line 5—5 of FIG. 4, the retaining disc being removed for clarity.
Figure 6:
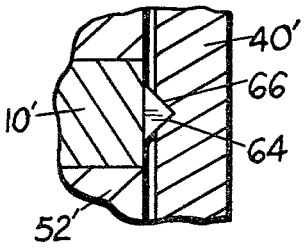
FIG. 6 is a fragmentary sectional view taken on the line 6—6 of FIG. 4.

With reference to FIGS. 4, 5 and 6, modified structure is shown between the hub or body portion 10' and hub portion 40' which provides a support between these members as well as a non-rotatable connection. For this purpose, the end of hub portion 10' between the grooves 62 has sharpened radially extending projections 64 arranged to fit in correspondingly shaped recesses 66 in hub portion 40'. The projections 64 and recesses 66 have a snug fit at the ends and bottom to provide the support and non-rotatable connection.

Figure 7:
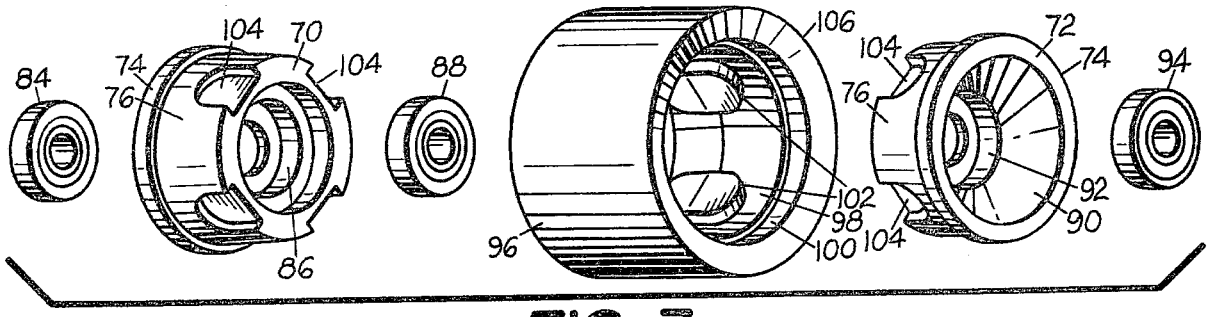
FIG. 7 is an exploded view of a skate wheel assembly embodying a second form of the invention.
Figure 8:
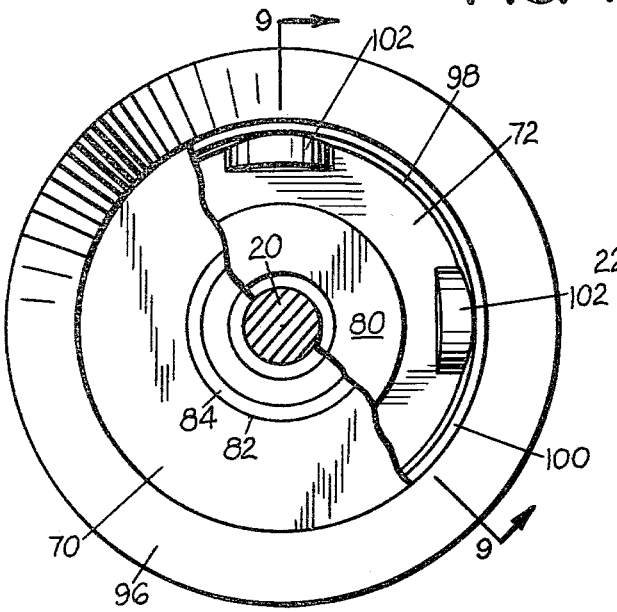
FIG. 8 is an end view of the wheel assembly of FIG. 7, this view being partly broken away and taken from the left side of FIG. 9.
Figure 9:
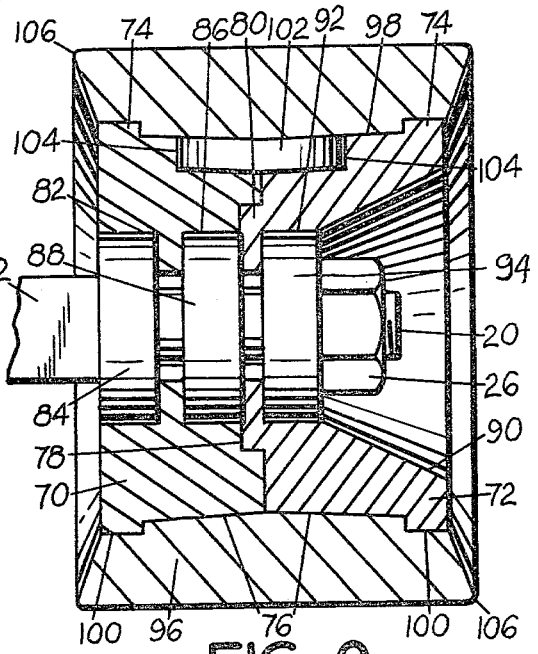
FIG. 9 is a sectional view taken on the line 9—9 of FIG. 8.

With reference to FIGS. 7, 8 and 9, a further embodiment of the invention is illustrated, such embodiment including a pair of hub portions 70 and 72 each provided with a peripheral flange portion 74 at one end and a cylindrical outer surface 76 inward of the flange tapered to a slightly smaller radius toward their inner ends. Hub portion 70 has a recess 78 in its inner end surface receiving a projection 80 on the inner end of hub portion 72.

Hub portion 70 also has a recess 82 in its outer end receiving a bearing 84 arranged for support on the spindle 20 of an axle 22, and this hub portion has a recess 86 leading inwardly from the bottom of recess 78 in its inner end receiving a bearing 88 also supported on the spindle 20. The outer end of hub portion 72 has a deep, tapered recess 90 leading into a recess 92 receiving a bearing 94. The hub assembly is held in assembled relation by an end nut 26 forcing the elements against the shoulder 24 of the axle. The three bearing support provides for efficient distribution of forces in the wheel.

The wheel assembly of FIGS. 7–9 includes a tire 96 constructed of rubber, plastic or other suitable material. The tire comprises a tubular open-ended member having an inner surface 98 tapered in opposite directions corresponding to the tapers of the surfaces of hub portions 70 and 72. The inner surface 98 of the tire has end notches 100 receiving the end flanges 74 on the hub portions and this inner surface also has a plurality of longitudinally extending tongues or projections 102 engageable in correspondingly shaped grooves 104 in the peripheral surfaces 76 of the hub portions which lead outwardly from the inner ends of the latter, the ends of these tongues and grooves being rounded. This tongue and groove connection as well as the flanges 74 provide a positive mounting of the tire on the hub portions to prevent accidental displacement of the tire. As in the embodiment of FIG. 1, the deep recess 90 is arranged to provide some flexibility to the outside portion of the wheel to minimize shock forces to the wheel, and in addition the ends of the tire 96 may be tapered or feathered to an edge 106 at the surface to provide additional flexibility and also to provide additional road grip.

The tire from its vertical center outward is symmetrical and thus can be mounted in either end to end position on the wheel. The tire thus can be turned end for end if uneven wear should occur. Installation of the tire is accomplished by inserting the two hub portions inward from opposite ends with the grooves 104 in engagement with the tongues 102.

Figure 10:
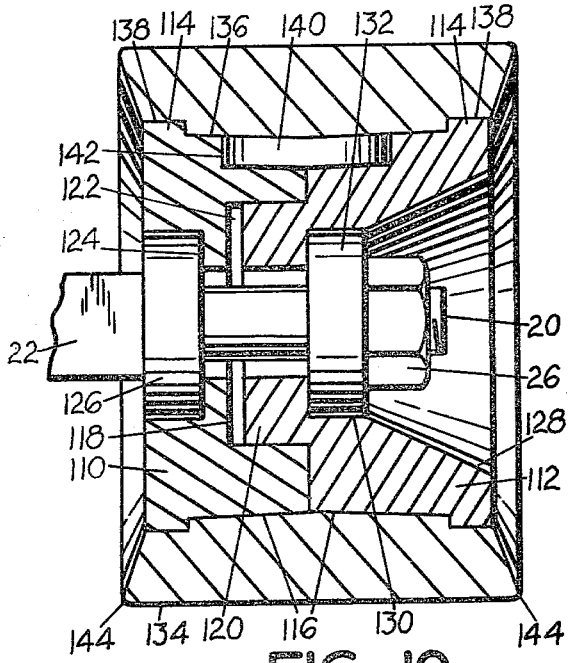
FIG. 10 is a sectional view similar to FIG. 9 but showing a further form of the invention.

With reference to FIG. 10, another embodiment is illustrated employing a pair of hub portions 110 and 112 each having a flange portion 114 at one end and a cylindrical outer surface 116 tapered as in FIG. 9. Hub portion 110 has a recess 118 in its inner end receiving a projection 120 on the inner end of hub portion 112, the recess 118 being of greater depth than projection 120 to provide a space 122 therebetween. Such space allows for selected tightening of the hub portions together on the spindle 20 of an axle 22 by nut 26.

Hub portion 110 has a recess 124 in its outer end receiving a bearing 126. Hub portion 112 has a deep, tapered recess 128 leading into a recess 130 receiving a bearing 132. The wheel assembly of FIG. 10 includes a tire 134 comprising a tubular open-ended member having an inner surface 136 tapered in opposite directions corresponding to the tapers of the surfaces of hub portions 110 and 112. As in the embodiment of FIG. 7, the inner surface of the tire has end notches 138 to receive the end flanges 114 on the hub portions and has a plurality of longitudinally extending tongues or projections 140 engageable with correspondingly shaped grooves 142 in the peripheral surfaces of the hub portions. Tire 134 is feathered at the edges 144. In this embodiment, the tire and hub engaging portions thereof are symmetrical so that the tire can be reversed.

According to the present invention, a skate wheel assembly is provided that accomplishes improved bearing support. Some of the embodiments use three bearings for maximum support and stress distribution. Thus, the wide-type wheels which are now popular have adequate and strain free support. If it is necessary or desirable to replace the tire portion, such is easily accomplished merely by removing the wheel and slipping on a new tire. This is an improved feature since it may not only be desirable to replace worn tires and thus save the expense of throwing the whole wheel away but to provide easy substitution of different types of tires for different skating conditions. The flanged locking engagement of the tire on the body portion, as well as the use of the tongues and grooves, prevents the tire from crawling off the wheel, even when the tire used is of somewhat resilient material. Various color combinations may be used by selectively interchanging tires of different color.

It is to be understood that the forms of my invention herein shown and described are to be taken as preferred examples of the same and that various changes in the shape, size and arrangement of parts may be resorted to without departing from the spirit of my invention or the scope of the subjoined claims.

Having thus described my invention, I claim:

1. A skate wheel assembly comprising (a) an axle having a free wheel supporting end with a removable nut thereon and an abutment spaced from said free end, (b) a hub removably supported on said wheel supporting end of said axle between said abutment and said nut, (c) bearing means rotatably supporting said hub on said axle, (d) said hub comprising a pair of members, (e) said two hub members having inwardly facing ends engageable with each other and also having outwardly facing ends, (f) said hub members having a circumferential tire engaging surface between said inwardly facing and outwardly facing ends and including a radially projecting flange adjacent to their outwardly facing ends, (g) an open ended tubular flexible tire having a circumferential outer surface and also having an inner surface arranged to be engaged with said tire engaging surfaces of said hub members, (h) the inner surface of said tire having end notches therein receiving said radially projecting flanges, (i) said tire engaging surfaces of said hub members tapering to a larger diameter from said inner ends to said flanges and said tire having correspondingly tapered inner surfaces fitting said tapered surfaces of said hub members, (j) said tire engaging surface and said flanges and notches being symmetrical on the two hub members and tire whereby upon removing the hub and tire from said axle, said tire can be turned end for end, (k) a plurality of inwardly extending spaced tongues integral with the inner surface of said tire extending from the longitudinal center of said tire toward opposite ends of the latter, (l) a plurality of recesses in said circumferential tire engaging surface correspondingly spaced and sized to snugly receive said tongues, (m) said tongues and recesses having radially extending straight defining edges, (n) said tapered surfaces and flanges, as well as said straight edges of said tongues and recesses, holding the tire against accidental displacement in axial directions.

2. A skate wheel assembly comprising (a) an axle having a free wheel supporting end with a removable nut thereon and an abutment spaced from said free end, (b) a hub removably supported on said wheel supporting end of said axle between said abutment and said nut, (c) bearing means rotatably supporting said hub on said axle, (d) said hub comprising a pair of members, (e) said two hub members having inwardly facing ends engageable with each other and also having outwardly facing ends, (f) said hub members having a circumferential tire engaging surface between said inwardly facing and outwardly facing ends and including a radially projecting flange adjacent to their outwardly facing ends, (g) an open ended tubular tire having a circumferential outer surface and also having an inner surface arranged to be engaged with said tire engaging surfaces of said hub members, (h) the inner surface of said tire having notches therein receiving said radially projecting flanges, (i) said tire engaging surfaces and said flanges and notches being symmetrical on the two hub members and tire whereby upon removing the hub and tire from said axle, said tire can be turned end for end, (j) the ends of said tire being tapered outwardly from said inner surface to said outer surface to form a sharpened edge at said outer surface, (k) and means on said hub portions and tire preventing relative rotation of said hub portions and tire.

3. A skate wheel assembly comprising (a) an axle having a free wheel supporting end with a removable nut thereon and an abutment spaced from said free end, (b) a hub removably supported on said wheel supporting end of said axle between said abutment and said nut, (c) bearing means rotatably supporting said hub on said axle, (d) said bearing means including a first bearing in said hub located adjacent to said free end of said shaft, a second bearing located adjacent to the other end of said hub from said first bearing, and a third bearing located between said first and second bearings, (e) said hub comprising a pair of members, (f) said two hub members having inwardly facing ends engageable with each other and also having outwardly facing ends, (g) said hub members having a circumferential tire engaging surface between said inwardly facing and outwardly facing ends and including a radially projecting flange adjacent to their outwardly facing ends, (h) an open ended tubular tire having a circumferential outer surface and also having an inner surface arranged to be engaged with said tire engaging surfaces of said hub members, (i) the inner surface of said tire having notches therein receiving said radially projecting flanges, (j) said tire engaging surfaces and said flanges and notches being symmetrical on the two hub members and tire whereby upon removing the hub and tire from said axle, said tire can be turned end for end, (k) and means on said hub portions and tire preventing relative rotation of said hub portions and tire.

* * * * *